US012653254B2

(12) United States Patent
Anstey

(10) Patent No.: US 12,653,254 B2
(45) Date of Patent: Jun. 16, 2026

(54) MEDICAL/DENTAL/UTILITY GLOVE WITH ANTI-FATIGUE AND AIR CHANNEL IMPROVEMENTS

(71) Applicant: Paul Anstey, Los Angeles, CA (US)

(72) Inventor: Paul Anstey, Los Angeles, CA (US)

( * ) Notice: Subject to any disclaimer, the term of this patent is extended or adjusted under 35 U.S.C. 154(b) by 0 days.

(21) Appl. No.: 16/890,914

(22) Filed: Jun. 2, 2020

(65) Prior Publication Data

US 2020/0375285 A1 Dec. 3, 2020

Related U.S. Application Data

(60) Provisional application No. 62/856,682, filed on Jun. 3, 2019.

(51) Int. Cl.
*A41D 19/00* (2006.01)

(52) U.S. Cl.
CPC ..... *A41D 19/002* (2013.01)

(58) Field of Classification Search
CPC ..... A41D 19/0055; A41D 19/0058; A41D 19/0062; A41D 19/0079; A41D 19/0082
See application file for complete search history.

(56) References Cited

U.S. PATENT DOCUMENTS 692,703 A * 2/1902 Pfeiffer ..... A41D 19/0062 2/168
1,097,018 A * 5/1914 Hadfield ..... A41D 19/0062 425/269
2,036,413 A 4/1936 Herbruck
3,283,338 A 11/1966 Landau
3,600,716 A * 8/1971 Berry ..... A41D 19/0062 2/167
3,601,816 A 8/1971 Pordes et al.
3,867,727 A * 2/1975 Povlacs ..... A41D 19/0062 2/167
4,189,787 A 2/1980 Stansbury
4,441,213 A 4/1984 Trumble et al.
5,304,337 A 4/1994 Chen et al.
5,323,490 A 6/1994 Yarbrough
(Continued)

FOREIGN PATENT DOCUMENTS

AU 5479369 11/1970
CN 1937967 A 3/2007
(Continued)

*Primary Examiner* — Sally Haden
(74) *Attorney, Agent, or Firm* — Welsh Flaxman & Gitler LLC

(57) ABSTRACT

The present invention is to an improved elastomeric glove having stress relief zones to reduce user fatigue. The glove may have stress relief areas between and over some or all of the joints, knuckles and bones of the hand, wherein the relief zones are formed of asymmetrical or symmetrical humps. Alternatively, these raised relief zone areas are formed of asymmetrical or symmetrical diamond shaped or frusto-diamond shaped zones. A relief zone can also be provided over the webbing between the thumb and the palm. A relief zone can also be provided over the soft tissue webbing between the thumb and the forefinger on the dorsal and ventral surface of the hand. The diamond/humped shaped relief zones provide for improved (consistent) glove function and quality while keeping manufacturing challenges and costs to a minimum.

13 Claims, 13 Drawing Sheets

(56) References Cited

U.S. PATENT DOCUMENTS

| | | | | |
|---|---|---|---|---|
| 5,442,816 | A * | 8/1995 | Seketa | A61B 42/00 2/161.7 |
| 5,644,797 | A | 7/1997 | Daneshvar | |
| 6,044,493 | A | 4/2000 | Post | |
| 6,253,382 | B1 | 7/2001 | Kleinert | |
| 6,272,687 | B1 | 8/2001 | Cunningham | |
| 6,709,617 | B2 | 3/2004 | Wu | |
| 6,760,923 | B1 | 7/2004 | Tate | |
| 6,962,739 | B1 | 11/2005 | Kim et al. | |
| 7,694,351 | B2 | 4/2010 | Gait | |
| 7,971,276 | B2 | 7/2011 | Eng et al. | |
| 9,179,718 | B2 | 11/2015 | Anstey | |
| D787,779 | S | 5/2017 | Williams et al. | |
| 9,974,611 | B2 | 5/2018 | Champagne et al. | |
| 10,130,438 | B2 | 11/2018 | Champagne et al. | |
| D873,500 | S | 1/2020 | Champagne et al. | |
| 10,791,778 | B2 | 10/2020 | Williams et al. | |
| 2002/0021628 | A1 | 2/2002 | Igarashi et al. | |
| 2002/0166156 | A1 | 11/2002 | Clark et al. | |
| 2002/0193488 | A1 | 12/2002 | Tao | |
| 2003/0204002 | A1 | 10/2003 | Osborn | |
| 2003/0230591 | A1 | 12/2003 | Jordan et al. | |
| 2004/0025222 | A1 | 2/2004 | Cass | |
| 2004/0176512 | A1 | 9/2004 | Tao | |
| 2005/0035493 | A1 | 2/2005 | Flather et al. | |
| 2005/0059764 | A1 | 3/2005 | Beck | |
| 2006/0026738 | A1 | 2/2006 | Kleinert | |
| 2006/0143767 | A1 | 7/2006 | Yang et al. | |
| 2006/0212990 | A1 | 9/2006 | Mattesky | |
| 2007/0226873 | A1 | 10/2007 | Mattesky | |
| 2008/0092270 | A1 | 4/2008 | Reber | |
| 2008/0134411 | A1* | 6/2008 | Shapiro | A41D 19/0058 2/161.7 |
| 2009/0007307 | A1 | 1/2009 | Le et al. | |
| 2009/0288237 | A1 | 11/2009 | Chen | |
| 2009/0307821 | A1 | 12/2009 | Chang | |
| 2010/0005564 | A1 | 1/2010 | Park | |
| 2011/0118635 | A1 | 5/2011 | Yamamoto | |
| 2013/0263356 | A1 | 10/2013 | Jones et al. | |
| 2013/0291282 | A1* | 11/2013 | Anstey | A41D 19/00 2/161.7 |
| 2014/0059739 | A1 | 3/2014 | Gellis | |
| 2014/0208481 | A1 | 7/2014 | Champagne et al. | |
| 2014/0259283 | A1* | 9/2014 | Govindasamy | A61B 42/10 2/161.7 |
| 2015/0181955 | A1* | 7/2015 | Hughes | A41D 19/01523 66/174 |
| 2015/0189932 | A1 | 7/2015 | Champagne et al. | |
| 2016/0120242 | A1 | 5/2016 | Thompson et al. | |
| 2016/0174634 | A1* | 6/2016 | Schatzberg | B29C 41/14 2/163 |
| 2016/0366959 | A1 | 12/2016 | Hull | |
| 2018/0360143 | A1* | 12/2018 | Williams | A41D 19/0062 |
| 2019/0357609 | A1 | 11/2019 | Williams et al. | |
| 2020/0375285 | A1* | 12/2020 | Anstey | A41D 19/0082 |
| 2021/0169159 | A1* | 6/2021 | Wong | A41D 19/0003 |

FOREIGN PATENT DOCUMENTS

| | | | |
|---|---|---|---|
| CN | 101822432 | A | 9/2010 |
| CN | 201640537 | U | 11/2010 |
| CN | 201640543 | U | 11/2010 |
| CN | 102247023 | A | 11/2011 |
| FR | 479502 | A | 4/1916 |
| FR | 796667 | A | 4/1936 |
| FR | 1175870 | A | 4/1959 |
| JP | S473921 | U | 9/1972 |
| JP | S57192918 | U | 12/1982 |
| JP | S61239003 | A | 10/1986 |
| JP | S6451618 | U | 3/1989 |

* cited by examiner

MEDICAL/DENTAL/UTILITY GLOVE WITH ANTI-FATIGUE AND AIR CHANNEL IMPROVEMENTS

CROSS REFERENCE TO RELATED APPLICATION

This application claims the benefit of U.S. Provisional Patent Application 62/856,682, filed Jun. 3, 2019, entitled "Medical/Dental/Utility Glove with Anti-Fatigue and Air Channel Improvements," which is incorporated herein by reference."

BACKGROUND OF THE INVENTION

1. Field of the Invention

The present application relates to an ergonometrically improved glove having areas near or within natural fold lines and stress build up areas of a user's hand with stress relief features to provide lower resistance to flexing and anti-fatigue enhancements during the functioning of the human hand and wrist.

2. Description of the Prior Art

Latex and other elastomeric medical gloves are used by medical and/or dental professionals to maintain a sanitary boundary between the medical staff (or other users/operators) and the patient. These gloves have also found their way into non-medical fields such as use by janitorial workers, food industry workers, automotive workers, painters, construction workers, hairstylists and more as a barrier to reduce the transfer of oils, paints, foams and chemicals etc. onto the worker. The inventions described herein can also be used to increase the usability of sports gloves and medical gloves as well as general gloves for other purposes.

Medical gloves are typically of uniform thickness throughout the glove to maintain a low cost by simplifying production. This has led to a mismatch between the flex patterns of the gloves and the flexing of the hand of the wearer. When the wearer bends his fingers, for example, the glove must stretch unevenly along the wearer's joints and beyond as all hands differ in muscle and skeletal structure. The amount of force required to stretch the glove during use tends to cause fatigue in the hands of the wearer and can cause other discomfort such as constriction of the hand. This glove "squeeze" causes the muscles of the hand to have to work extra hard, beyond the normal efforts needed during "glove-free" muscle flexing and hand function. To add to this, "glove squeeze" and the associated resistance causes pressure on the multiple bones of the hand, fingers and wrist that can result in pain and added fatigue thus affecting function. These effects can also lead to medium and long-term medical complications to the wearer.

Additionally, as the glove stretches on one side of the user's hand, an area elsewhere on the hand may also experience bunching/sagging of the material as it folds on itself, for example, bunching beneath the joint of the fingers. In addition to the above disadvantages, this can reduce the tactile feel through the glove and interfere with the grasping of delicate instruments. A wearer therefore often wears ill-fitting ("larger") gloves than the wearer's hand size to reduce fatigue with disadvantage of bunching at the fingertip or elsewhere than interferes with the grip and with the tactile feedback. What is needed is an improved, easily produced glove with economical, ergonomic anti-fatigue features that does not interfere with the natural operation of the hands of the wearer.

Some efforts have been made in the past to provide stress relief areas. One such device is shown by Yarbrough in U.S. Pat. No. 5,323,490. A number of bellows are provided along two fingers of the glove to provide circumferential flex areas, but too much flexure provided by the bellows causing the fingertips of the gloves to become too loose. Additionally, the portion of the bellows below the finger (palm side) is unnecessary and in the way, causing a hindrance to an operator grasping an instrument, for example. Also, the Yarborough invention does not account for the slippage of the glove material vertically along the finger during use which causes bunching and wrinkling of the glove material at the finger tips with obvious hindrance to use and interference with instrument handling and tactile feedback. Other inventors (see Patent Application Ansel WO2017124134A1) have attempted alternate designs for stress relief areas but they do not address the slipping and bunching of the glove material nor do they demonstrate anything novel that has not already been invented. Thus, this cited invention does not add any uniqueness to the field for improved glove design.

A number of other gloves also provide various solutions, such as U.S. Pat. Nos. 3,283,338, and 6,962,739. However, none of these inventions and patents, taken either singly or in combination, is seen to describe the instant invention as claimed.

SUMMARY OF THE INVENTION

The present invention is to an improved glove having stress relief zones manufactured into the glove to ease the bending of the user's joints and to ease hand squeeze. The glove may have convex relief zones or pockets over or adjacent to one or more of the joints and knuckles of the hand, wherein the relief zones are preferably formed of asymmetrical or symmetrical elongated humps over the finger and thumb joints and adjacent to or over the knuckles. A hump shaped relief zone can also be provided over the webbing on the dorsal and ventral surfaces between the thumb and the index finger on the dorsal and ventral ("palm") side (as well as other areas shown in the diagrams). These relief areas may also be formed by asymmetrical or symmetrical diamond shaped, modified diamond shaped or by elliptical shaped horizontal or vertical zones. The relief zones described herein provide for improved (consistent) glove quality while keeping manufacturing challenges and costs at a minimum. These relief zones can also have a concavity at the peak of the relief zone so as to lower the profile and provide additional material for expansion as is needed in the various relief zones. Additionally, the relief zones and features mentioned herein, can be linear or non-linear in nature.

Accordingly, it is a principal object of a preferred embodiment of the invention to provide an improved glove having both anatomically correlating and/or anatomically adjacent stress relief zones to provide stress relief and to prevent the glove material from slipping and bunching at fingertips during the function of the glove thereby preventing a reduction in the functionality and tactile feedback, etc.

It is another object of the invention to provide air release channels incorporated into the glove during production to relieve any air entrapment that may occur during the donning of the glove.

It is an object of the invention to provide a glove having a number of elongated, vertically aligned hump-shaped/ modified diamond shaped relief zones on the glove to provide glove stretch relief areas, having extra material in the relief zone in a shape substantially transverse to the axis of rotation of the fingers during flexing. ("Longitudinal relief zones").

It is an object of the invention to provide a glove having a number of elongated, horizontally aligned hump-shaped/modified diamond shaped/elliptical relief zones on the glove to provide glove stretch relief areas, having extra material in the relief zone in a shape substantially parallel to the axis of rotation of the fingers during flexing. (Horizontal relief zones)

One skilled in the art would recognize that these relief zone areas can also be elliptical in shape and rotated horizontally or vertically without departing from the scope of my invention.

It is a further object of the invention to provide a glove having a number of stress relief portions to reduce the strain on the hands as the glove stretches around the bending hand and fingers.

Still another object of the invention is to provide a number of stress relief zones that have elliptical folds to provide stress-free stretching of the glove around the joints and body of the fingers, hand and wrist.

Still another object of the invention is to provide a number of stress relief zones that have asymmetrical or symmetrical diamond shaped/hump shaped/modified diamond/modified hump shaped relief areas to provide stress-free stretching of the glove around the joints and body of the fingers, hand and wrist.

It is an object of the invention to provide a glove which allows the hand to assume its natural curvature ("cascade effect") and dramatically reduce stress and fatigue caused by high stress zones.

It is an object of the invention to provide improved elements and arrangements thereof in an apparatus for the purposes described which is inexpensive, dependable and fully effective in accomplishing its intended purposes.

Another object of the invention is to provide a glove and hand former that allows stress relief for the user by providing the appropriate stress relief zones in an ambidextrous (symmetrical) style glove.

These and other objects of the present invention will be readily apparent upon review of the following detailed description of the invention and the accompanying drawings. These objects of the present invention are not exhaustive and are not to be construed as limiting the scope of the claimed invention. Further, it must be understood that no one embodiment of the present invention need include all of the aforementioned objects of the present invention. Rather, a given embodiment may include one or none of the aforementioned objects. Accordingly, these objects are not to be used to limit the scope of the claims of the present invention.

DETAILED DESCRIPTION OF THE PREFERRED EMBODIMENT(S)

The present invention according to at least one aspect is to an improved glove having stress relief zones to increase the ergonomics, comfort and usability of the glove.

Figure 1:
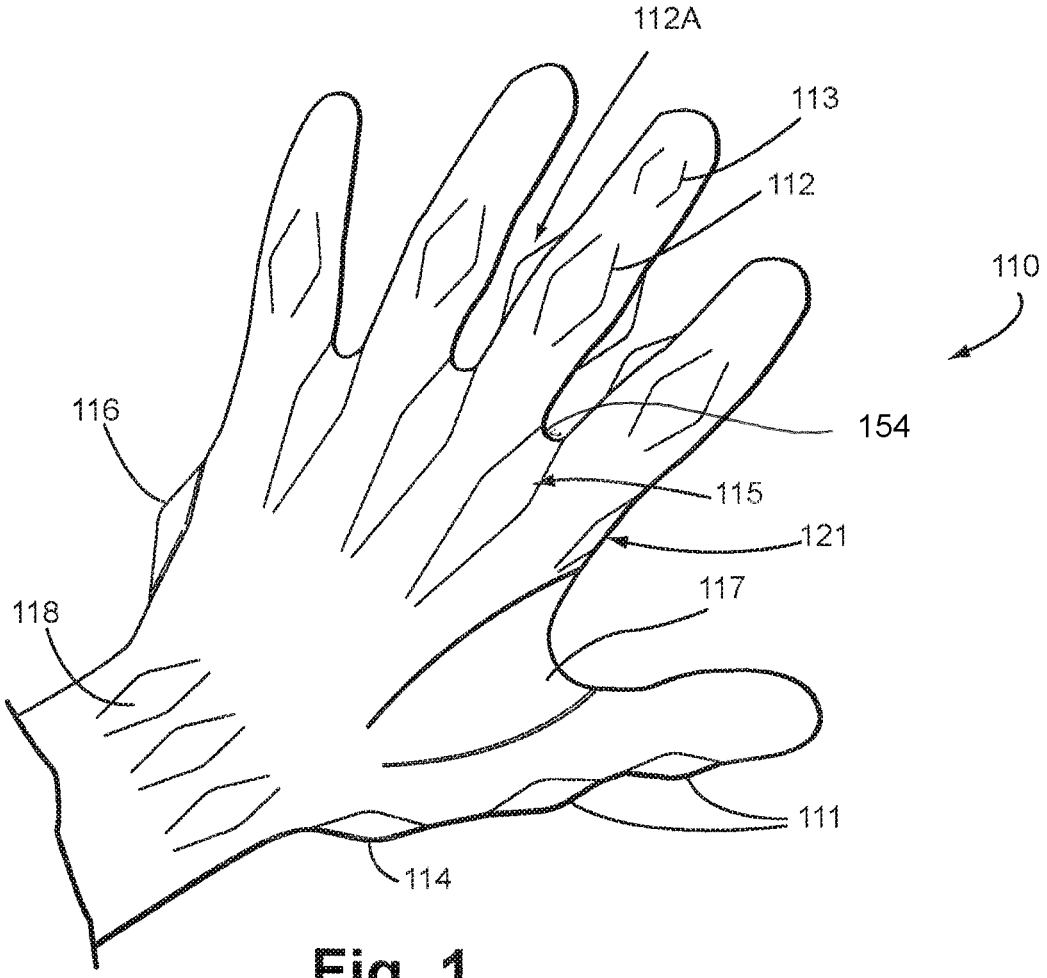
FIG. 1 is a dorsal plan view of a glove according to at least one aspect of the invention.

FIG. 1 shows an exemplary embodiment of the back ("dorsal" side) of a glove 110 according to at least one aspect of the invention.

Figure 1A:
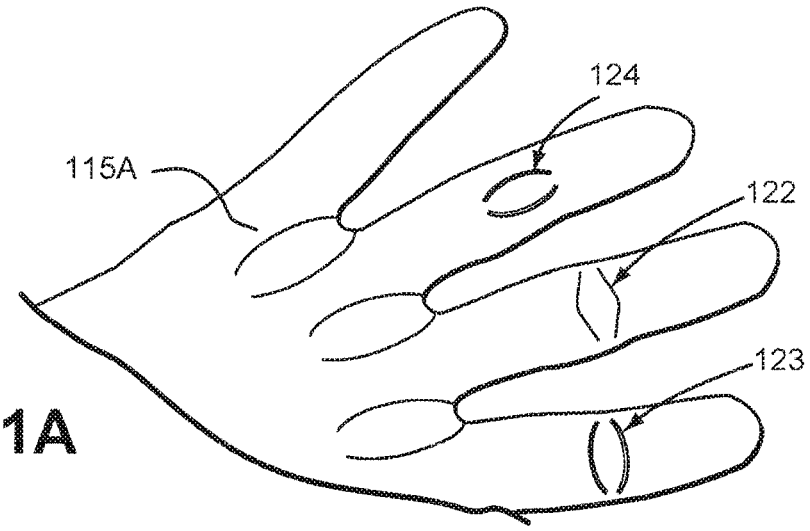
FIG. 1A shows alternate embodiments of the relief zones of the glove.

FIG. 1A shows an alternate embodiment of elliptical, arcuate and modified diamond shape relief zones.

Figure 2:
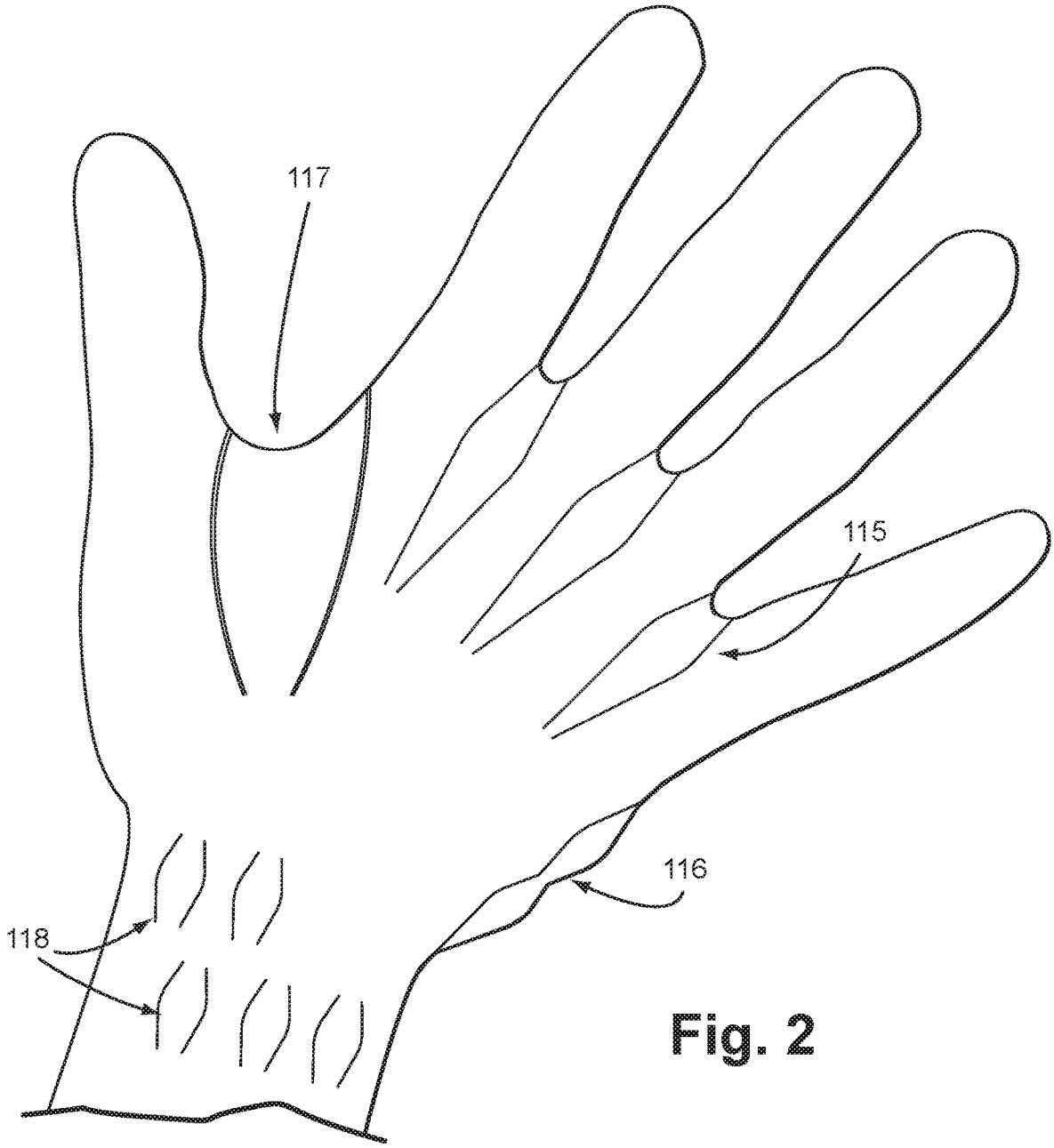
FIG. 2 is a ventral ("palm side") plan view of a glove according to at least one aspect of the invention.

FIG. 2 shows the front (or "ventral/palm" side) of the glove.

Figure 3:
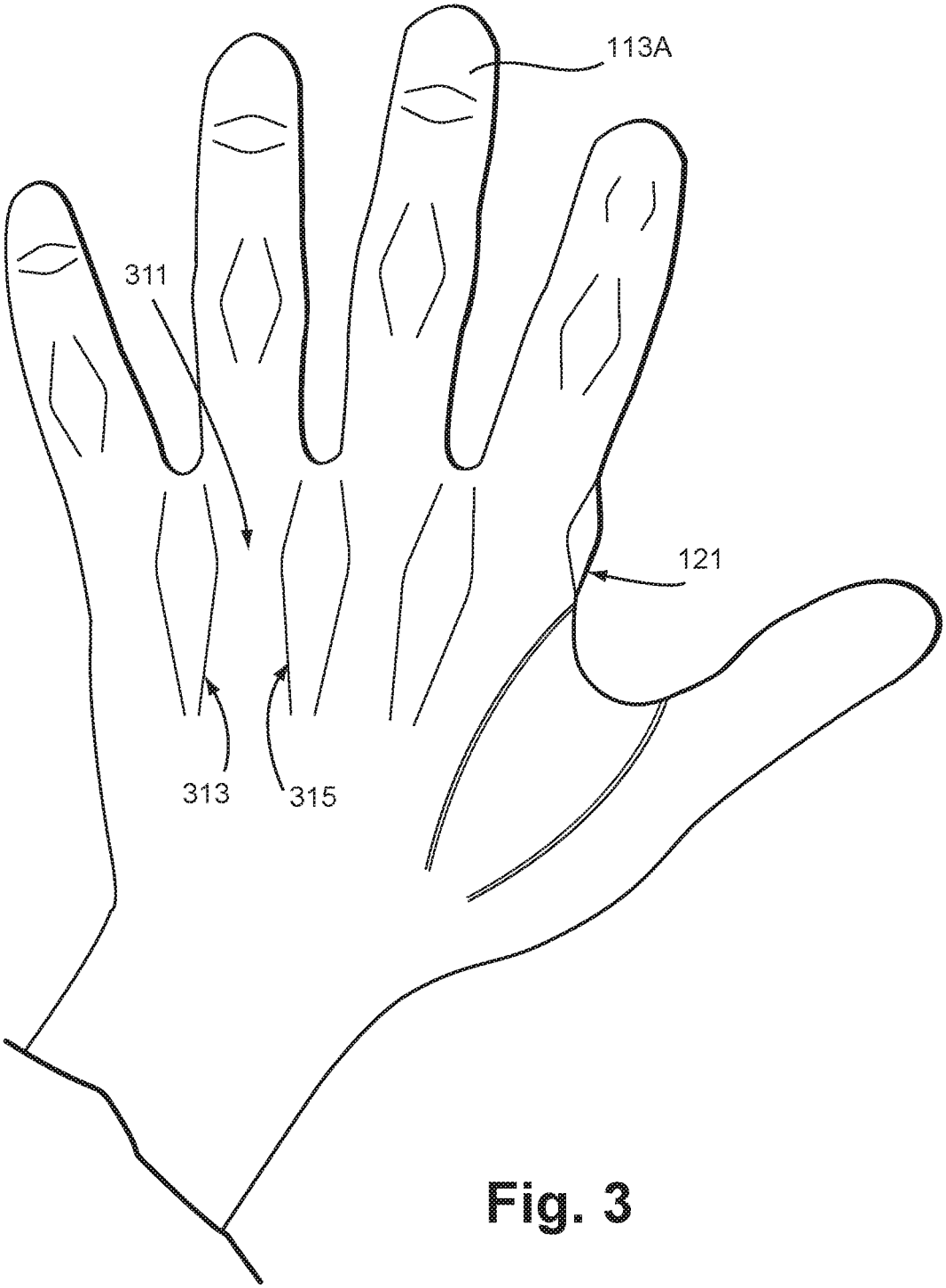
FIG. 3 is a dorsal or ventral view depending on if a hand specific or ambidextrous glove is used of a further embodiment of the glove.

FIG. 3 shows a dorsal or ventral view depending on if a hand specific or ambidextrous glove is being shown.

Figure 3A:
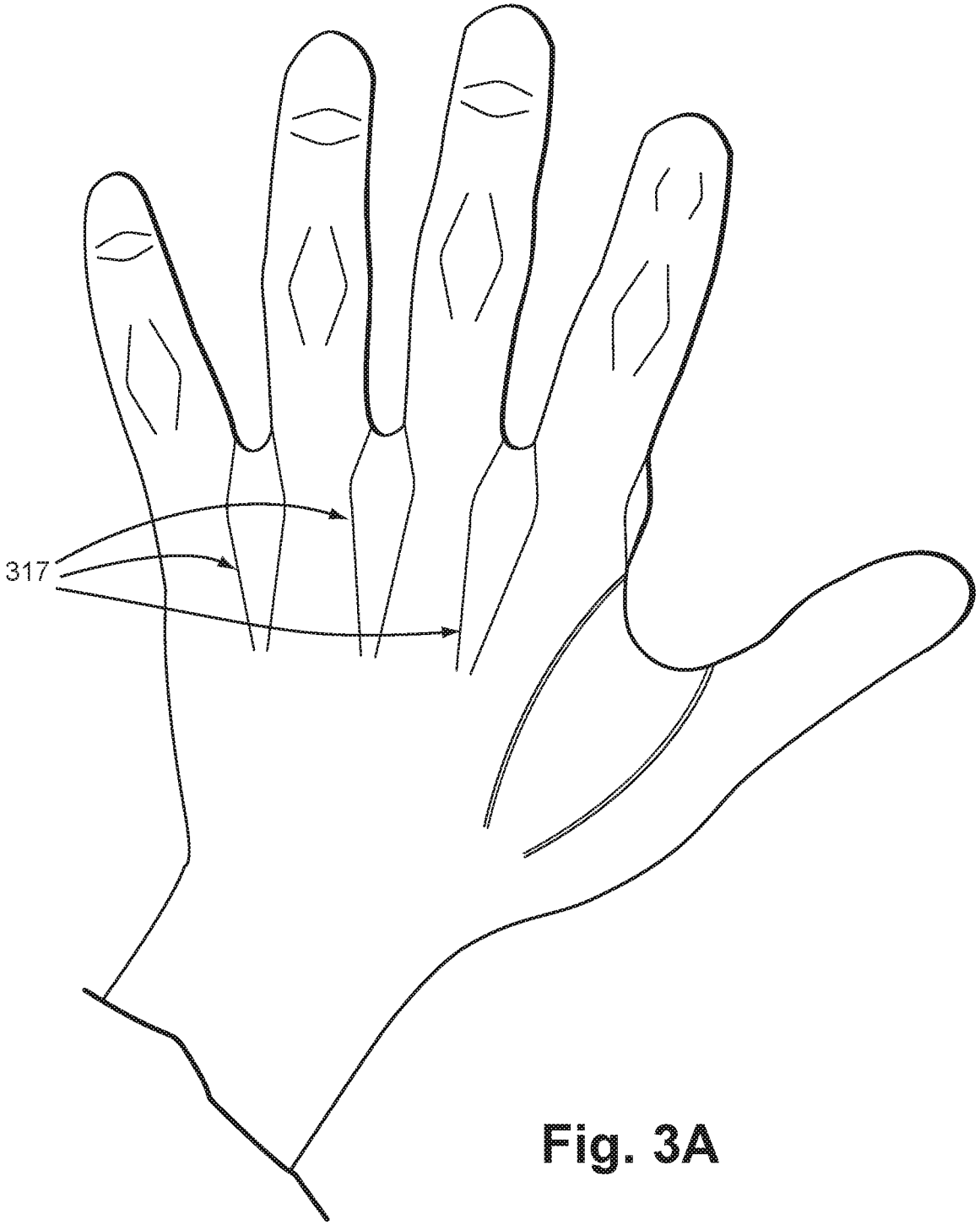
FIG. 3A is a dorsal or ventral view depending on if a hand specific or ambidextrous glove is being shown of yet another glove embodiment.

FIG. 3A is another embodiment of a dorsal or ventral view depending on if a hand specific or ambidextrous glove is being shown. The figure shows the relief zones 317 extending through the crotch of the fingers.

Figure 4A:
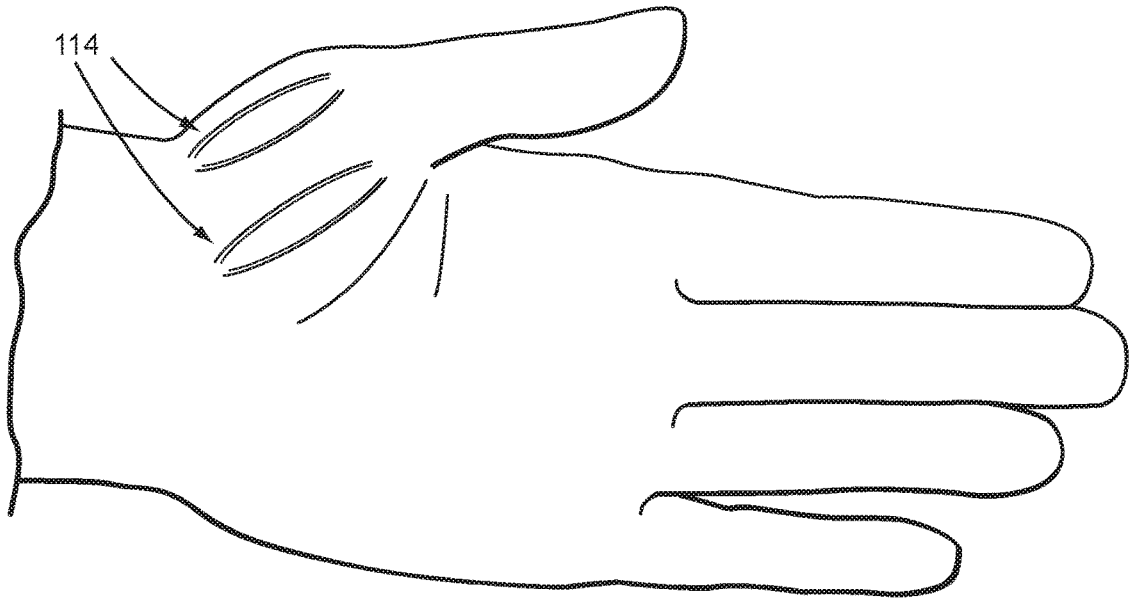
FIGS. 4 and 4A are views of a glove having relief zones along the thumb and forefinger according to other aspects of the invention.
Figure 4:
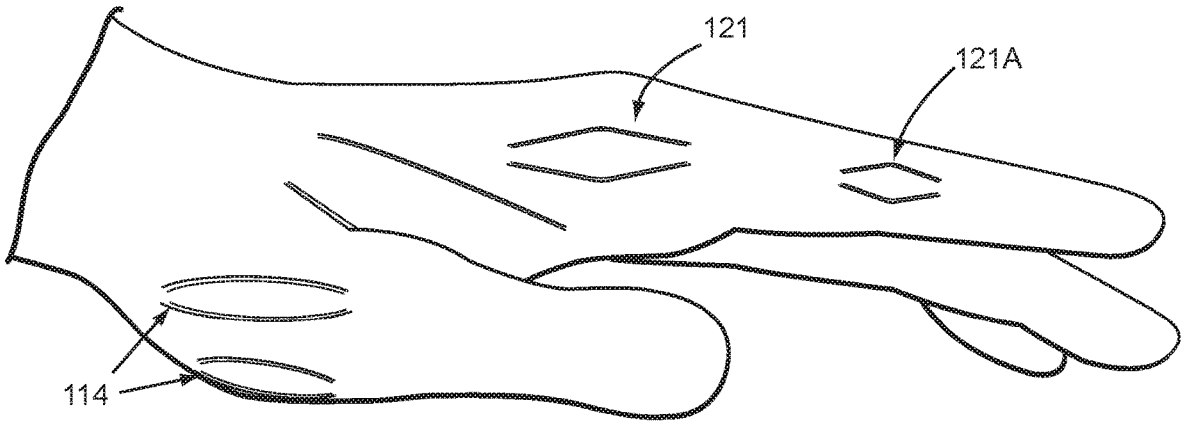

FIG. 4 shows the lateral aspect of the glove on the thumb side of the hand.

FIG. 4A demonstrates relief zones 114 over the thumb muscles and over the base area of the thumb.

The different zones on the dorsal side, ventral side and lateral aspects of hand are stretch/relief zones. Additional zones on the dorsal side of hand 119 (FIG. 5) show air release zones that release air trapped during donning. These zones could also be on the ventral side of the hand.

In practice, a glove would be constructed of a thin layer of uniform latex, nitrile, vinyl, polyisoprene, neoprene or other elastic or elastomeric material, typically by dip molding using a hand former in the desired shape of the glove. For the purposes of this application, any of these materials will be collectively referred to as "polymeric" and a glove formed from any of these and similar materials will be referred to as "polymeric gloves," unless explicitly noted otherwise. According to a preferred embodiment of the invention, at least one stress relief area 112 (FIG. 1) is provided above the knuckles (knuckle joints, finger joints, etc.) of the hand and located within preferably a uniform thickness main glove portion. However, the glove does not need to have a uniform thickness to practice the invention.

This expansion zone 112 reduces the amount of force necessary for the material of the glove to bend around the knuckles (or "joints") of the hand as one or more fingers are curled to grasp a medical/dental instrument, for example. By providing the additional material/space in the relief zones in a type of ballooned area or a "pocket," the wearer experiences less fatigue, since the fingers can move a greater distance (or bend further) before the glove material is stretched to accommodate movement or curling of the finger(s). These expansion zones are designed to provide less resistance to stretching or elongating along the length of the finger compared to the lateral ("circumferential") direction and compared to material outside the expansion zones of the glove.

An additional feature of the relief zones is that there is less constriction of the user's hand during operation from the glove elongating. When an elastic material such as rubber stretches/elongates, it simultaneously narrows, the same as a rubber band will narrow as it is stretched. Since the glove is already adjacent the skin of the wearer, the stretching of the glove will narrow about the hand causing constriction and discomfort of the hand. By providing additional material and free space via the design of the expansion zones, the anatomical displacement, volume change and movement of the joint bones and overlying soft tissue, can be accommodated by the relief zone areas of expansion instead of actually requiring significant "stretching" of the material.

FIGS. 1, 1A and 2 show different embodiments of the invention. A glove 110 made of latex, nitrile, vinyl, polyisoprene, neoprene or other elastomeric material or similar material is shown. However, one skilled in the art would recognize that portions of this invention could be applied to gloves of any material.

One or more relief zones 111, 112, 112A, 113, 113A, 114, 115, 115A, 116, 117, 118, 121, 122, 123, 124 may be manufactured into the glove.

A first set of relief zones 112 ("digit relief zones") are sited over the joint between the intermediate and proximal phalanges of each finger. A second set of relief zones 113 are located over the joint between the distal and intermediate phalanges of each finger. A third set of relief zones 115 or 115A are located between the metacarpal bones and can extend into the webbing areas adjacent to the proximal phalanges. These relief zones can also extend from one side of the hand to the other ("wrap") or not extend from one side to the other (i.e., break/separate) through the crotch areas between the fingers and can be on both the dorsal and/or ventral side of the glove (or on the dorsal side only). The relief zones could also extend only along a bone partially or fully instead of over the joint between adjacent bones depending on the needs of the glove. The relief zones 115/115A could also extend over the metacarpo-phalangeal (MCP) or other joint, partially or fully, between adjacent bones depending on the needs of the glove.

Figure 6:
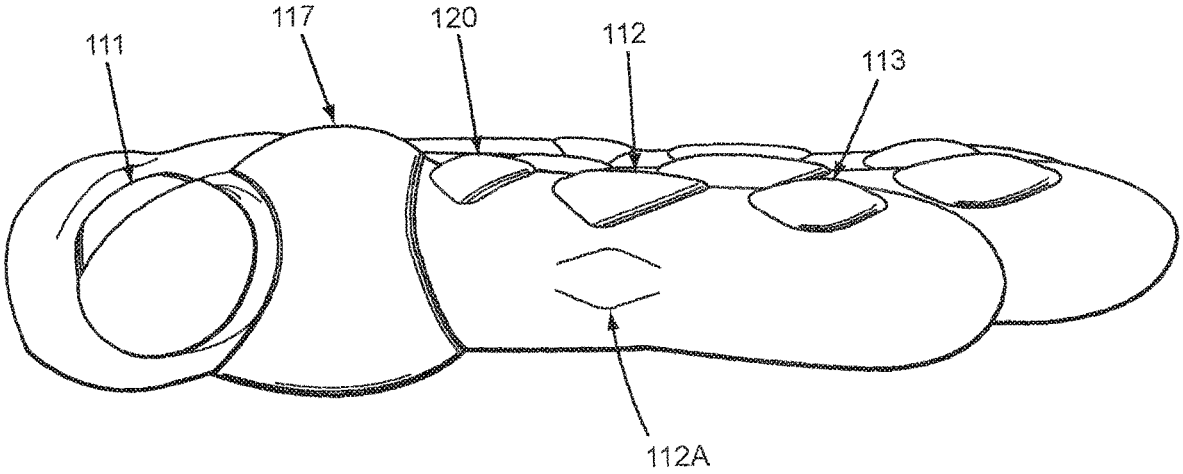
FIG. 6 is a side view showing the finger/thumb tip area demonstrating the continuous thumb webbing relief zone.
Figure 6A:
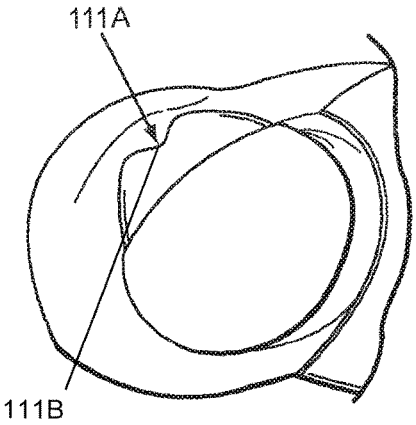
FIG. 6A is a partial view of a glove having an alternate embodiment of the thumb, finger or any relief zone.
Figure 7:
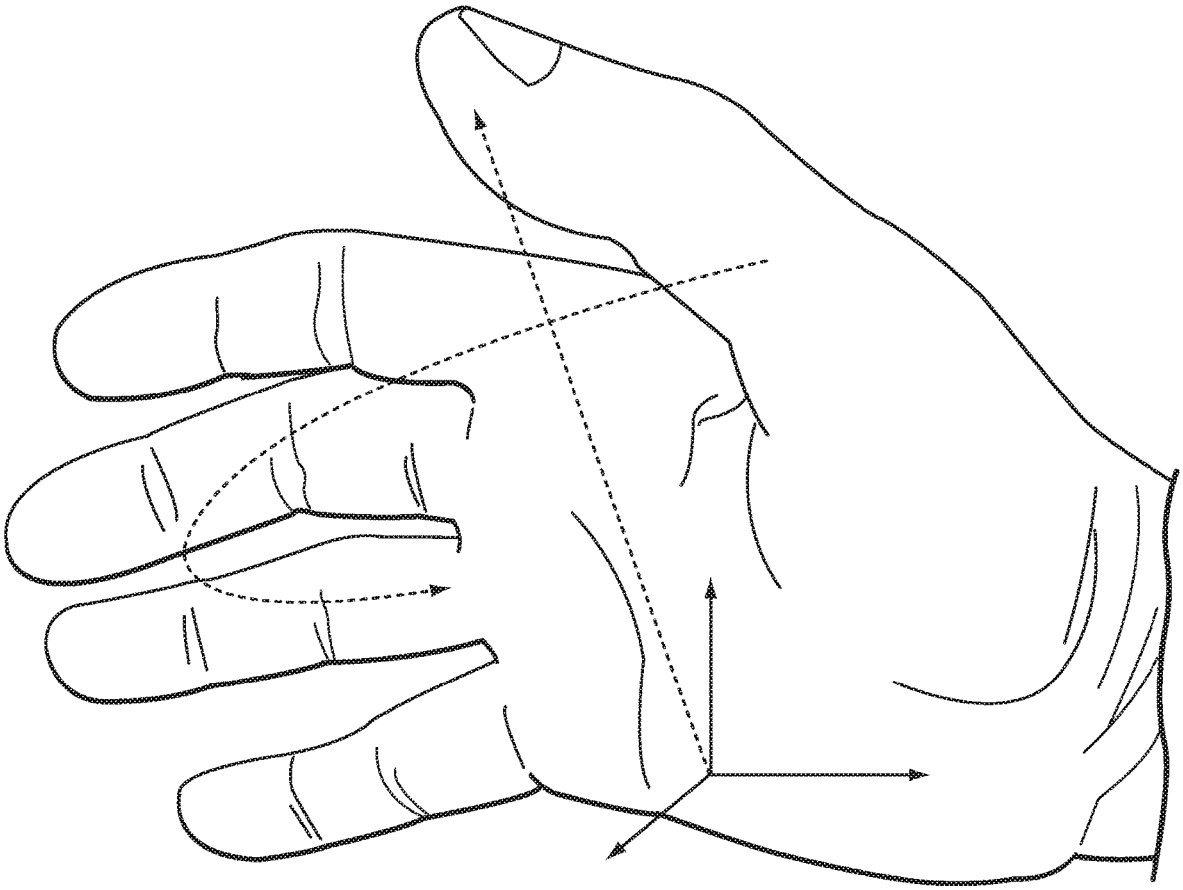
FIG. 7 is a diagrammatic view of a hand showing the axes of rotation of the hand.
Figure 8:
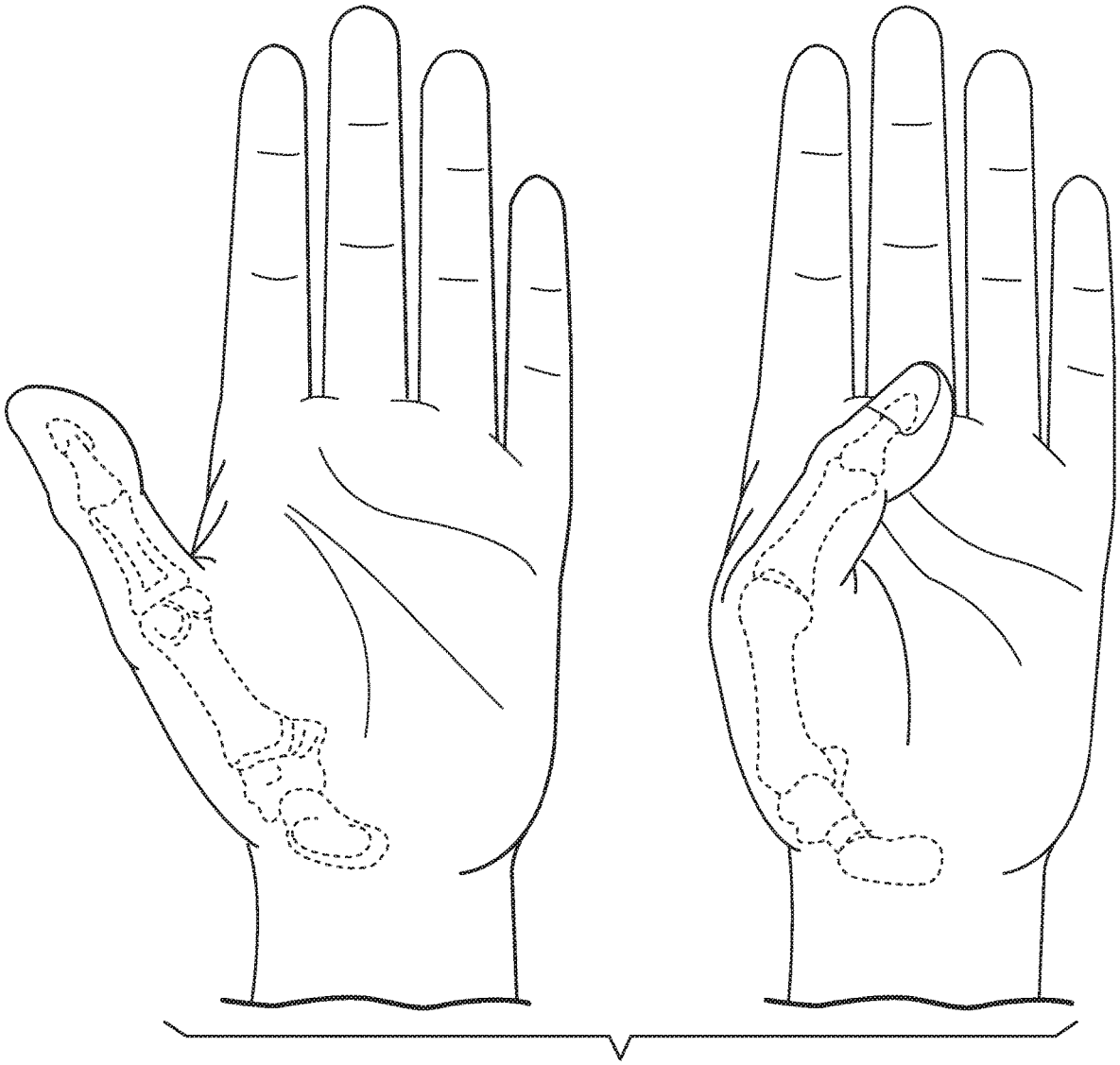
FIG. 8 is a diagrammatic view of the hand showing the bones and movement of the thumb.

FIG. 6A shows an alternative version of the relief zone 111A having a lower profile. By creating a vertical or horizontal ridge or groove 111B in the center, the overall volume of the relief zone is lower while maintaining its function. The twin peaks of the relief zone allow for a more compact relief zone. This groove can run the entire vertical length of a relief zone or only in part of a relief zone. The same applies to a horizontally oriented relief zone. This feature can apply to any relief zone described in this application.

A similar relief zone 121 (FIG. 1) can be located on the lateral side of the index finger at or near the MCP joint of that finger.

Another similar relief zone 121A (FIG. 4) can be located on the lateral aspects of the fingers.

A fifth relief zone 111 is provided over the joint of the thumb, namely between or over the area of the distal and proximal phalanges of the thumb and over the MCP joint of the thumb. One, none or both of these relief zones can be used in a preferred embodiment.

A sixth relief zone 114 is located in the vicinity of or over the carpo-metacarpal joint of the thumb, the associated metacarpal/carpal bones and the adjacent Thenar muscle group/muscles.

A seventh relief zone 117 is sited over the webbing of the thumb/dorsal side of hand and may or may not wrap through the crotch area between the thumb and forefinger over to the ventral side of the hand. An alternate embodiment of this relief zone can also be a non-connecting, dual relief zone located on both the ventral and dorsal side but not continuing through the thumb crotch area. This relief zone can be on only one side namely on the dorsal or ventral side of the hand in this location. This relief zone can have the feature of a central groove or concavity as is demonstrated in FIG. 6A (111A) that runs the entire length or partial length of the relief zone.

An 8th relief zone 116 is sited on the lateral side on the pinkie side of the hand.

A ninth set of wrist relief zones 118 is located over the wrist joint area (carpometacarpal joint area) and/or over the area of the carpal, radius and ulna bones. These relief zones can be present on the dorsal or the ventral side of the wrist and/or forearm or in combination on both sides. These relief zones can be frusto-diamond, elliptical, arcuate, hour glass or substantially parallel shaped.

Figure 9A:
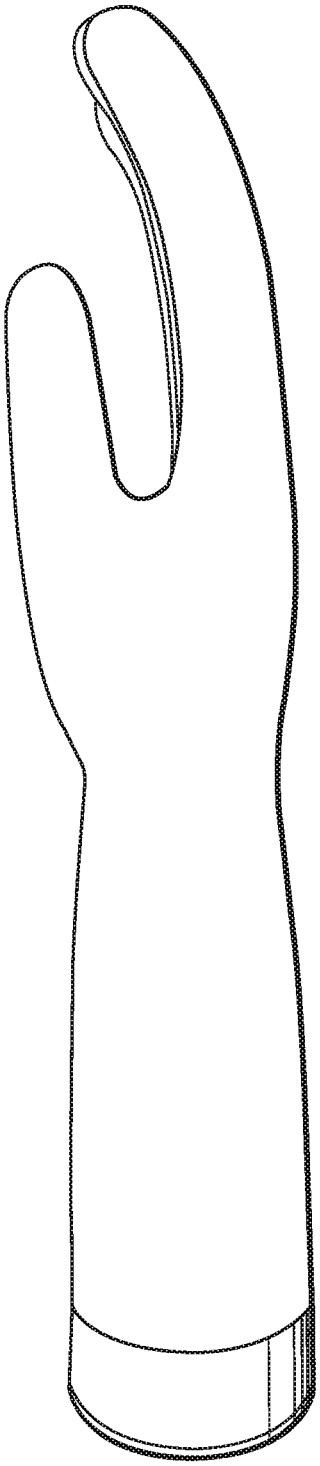
Fig. 9A Prior Art
FIG. 9A show a diagrammatic view of a prior art mold for an asymmetric glove.
Figure 9B:
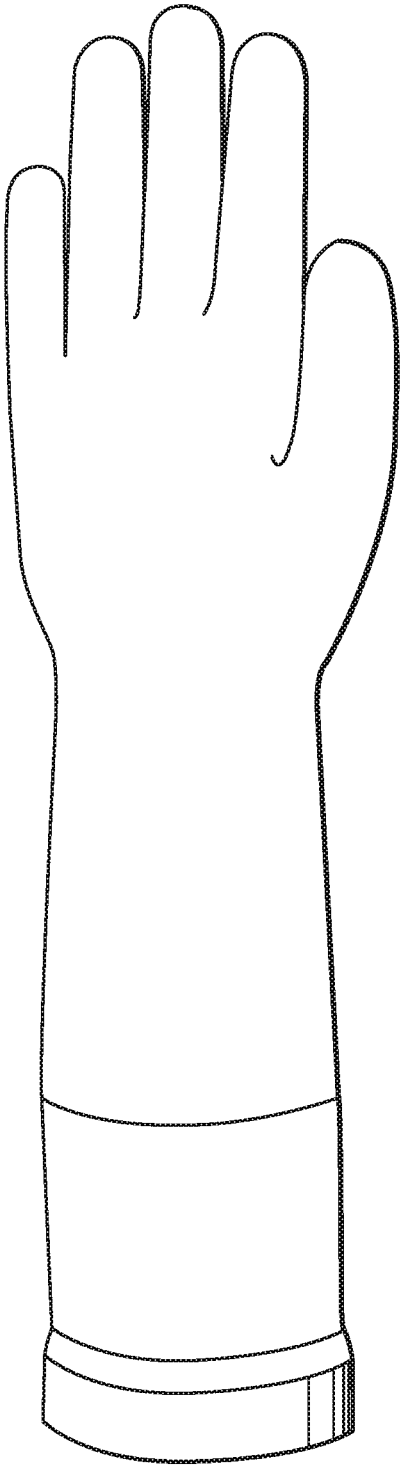
Fig. 9B Prior Art
FIG. 9B show a diagrammatic view of a prior art mold for a symmetric glove.

FIGS. 9A & B show another basic concept of the invention. FIGS. 9A & B show prior art hand formers ("molds") for use in dip molding (explained further hereunder). The molds can be asymmetric (FIG. 9A) or symmetric (FIG. 9B). Note that the advantage of an asymmetric glove is that it can be formed partially with the natural curvature of the hand to fit a hand better and to provide a pre-bend to the glove.

The symmetric glove is more planar but can be worn on either hand because it is substantially symmetric about a plane. Note that the forms are also smoothed out and do not have bulges where the knuckles/joints, or other areas of stress build up during function, would be. This may allow the glove to fit more hand sizes and shapes and may make the dip-mold process more smooth/streamlined because there are fewer obstacles to obstruct the flow of the elastomeric glove-making fluid about the mold.

For the purposes of this application, we will refer to gloves using these types of standard hand formers as a standard asymmetrical glove (FIG. 9A) and a standard symmetrical glove (FIG. 9B). The disadvantages of this approach making gloves on standard formers is that the anatomical areas where stress builds up during glove use are not addressed and therefore the user may experience damaging hand squeeze, the associated fatigue and the negative outcomes associated with that for the user and for the outcomes of procedures alike.

By altering the hand former to have raised, vertically-oriented, elongated "humps" (FIGS. 1-3) or "pockets" extending outwardly from a standard hand former shape, the glove can be made with "slack" zones between and slightly over the metacarpophalangeal (MCP) joints and bones in the area. The direction of these raised areas has an axis somewhat parallel (for example +/−20 degrees of parallel) to the long-axis of the hand and can extend into the area between metacarpal bones and into the area between the proximal bones. This slack allows the glove to fit comfortably and to have some "give" in the region of the MCP joints and beyond when the fingers are bent or when a fist is made ("balled") before the slack is taken out of the glove and the glove begins to more significantly resist movement of the hand. This allows the hand to bend farther in the improved glove before the glove begins to stretch than in the same size glove made using a standard hand former because of the slack built into the glove. The hump/pocket provides this extra material.

One such relief zone 115 (FIG. 1) exemplifies a preferred shape of the relief zone. The relief zone is a frusto-diamond shape but could also be an hour glass shape, parallel shape or other shapes. The points of the diamond are all preferably missing, having been smoothed out. This allows for a smoother transition between the non-relief portion of the glove and the relief portion. It is desired that the materials flow smoothly as they are forming the glove. The relief zone may have three-dimensional shaping properties such as an arcuate form following the contour of the hand that it overlies. For the purposes of this application, unless otherwise explicitly stated, a frusto-diamond shaped shape is in the general shape of a diamond, where the points have been eliminated to provide a smooth transition from one side of the diamond to another. The frusto-diamond shape has three-dimensions and may be generally flat or arched or some combination thereof depending on the area of the hand or finger that it covers. The diamond shape may be symmetric along one, two or no axes, especially when stretched.

It is important to remember that although the figures look like a separate material forms the relief zone, it is merely formed by a raised area designed as a hump or pocket away from the standard hand former surface to create a balloon or pocket of the glove material. The liquid latex or other material flows down and away from the hand former during dipping to form a layer of material about the glove that is slightly exaggerated from a normal hand contour.

The relief zone may be similar in all other aspects to the glove except that it has a different shape to provide a pocket of relief zone in the glove, but may be the same color, thickness and material as the rest of the glove. The pocket shape is important to provide less spring force in resistance to the bending of the hand. If the frusto-diamond shape had points or sharp areas, the glove may more easily develop imperfections such as pin holes, inconsistencies or folds if the flowing material is disturbed. The smooth areas and transition zones reduce sharp edges so as to allow the fluid to flow more smoothly between the disparate areas.

This design feature is important to allow a smooth and homogenous flow of elastomeric materials during the manufacturing process, while still providing an effective stress relief area. The heated, elastomeric materials collect on the hand mold during dipping. The excess material flows down the mold and off the mold when the former is removed from the pool of liquid materials ideally leaving a smooth, relatively uniform thickness of material on all portions of the mold. The development and resultant contouring/design features of the various relief zones are thus critical to ensure this even flow of materials during manufacture so as to create a functional and effective relief feature.

This offers relief zones that provide less resistance to flexing than the non-relief zone portions, thus improving functionality and comfort for the wearer. The improved glove also helps maintaining the position of the glove on the hand and resisting glove slippage by allowing a more form fitting glove to be used that provides the same comfort as a larger glove (over-sized glove). It should be noted also that in practice, the humps/relief zones could be over a bone in the hand, over a joint in the hand, over soft tissue areas of the hand or some combination thereof.

When dip molding is used (as explained further hereunder), the glove can have a near uniform thickness in the main glove and the relief zones and still allow for reduced resistance to flexing. The relief zones in this case allow for lower flex-resistance ("spring force") in the relief zones described which offer less resistance to bending than if the glove had been made strictly along the circumference and contour of a regular hand former (with no relief zones) such as in FIGS. 9A & B. The gloves can also be ambidextrous ("symmetrical"). By making the ventral and dorsal sides of the glove symmetric, a single glove can be used for either hand. The symmetry may allow some relief zones to cross over to the opposite side of the hand, or the relief zones may stop prior to the edge (crotch areas) between the two sides.

Another important feature of the relief zone in reducing the spring force is by having side or adjacent relief zones such as shown in FIGS. 1, 2, 3, 4, 4A (references 112A, 114, 116, 121, 121A).

The main force resisting flexing, extension and movement of the fingers and hand is the material of the glove. By cutting the glove in specific areas it becomes apparent how the flex form of the material can be changed and where the reduction in stress is most beneficial to the functioning of the hand. The main goal is to reduce or eliminate these stresses on the hand. Thus, in so doing (by "removing material" as described) this weakens the spring forces that build up in a standard glove. In other words, the glove material in area 311 (FIG. 3) as an example which restricts hand/finger movement in the area of a knuckle or joint, can be altered by making cuts in the glove for example along the areas 313 & 315. However, since the goal of a glove is to create a relatively impermeable barrier, cuts would not be a practical solution to the problem of stress build up. Instead, by creating pockets of different shapes and sizes in various locations such as 313, 315, the reduction or elimination of the spring forces associated with the glove material is the solution. Stress relief areas 313 & 315 are examples of non-obvious solutions to the challenges described above. The location of other stress reducing relief zones described in this application are based on similar experimentation and discovery.

Relief zones 114 (FIG. 1, FIG. 4 & FIG. 4A) are preferred to be elliptical or arcuate in shape but can be any shape. They can be symmetrical, asymmetric, linear or non-linear. There can be one or more of these relief zone structures built into the glove/hand former and these relief zones can be located on the dorsal, ventral and/or lateral side of the glove as desired so as to suit the particular goals of a glove.

Their function is to reduce the stress forces experienced in the underlying muscles in that area as the thumb bends and moves on its axis of rotation. These relief zones also serve a secondary function in that they help to reduce the spring forces experienced in the thumb webbing and palm area as previously illustrated and described.

Relief Zones over distal interphalangeal (DIP), the proximal interphalangeal (PIP) joints and the thumb webbing relief zones are also shown and have been previously described in this document. They can also be incorporated into an ambidextrous glove by having relief zones that mirror each other on opposite sides of the glove. It should be noted that this concept of mirror image glove can be applied to any of the embodiments shown in this application, and any relief zones in any one embodiment may be used interchangeably with another embodiment to suit the particular goals of a glove.

Figure 5:
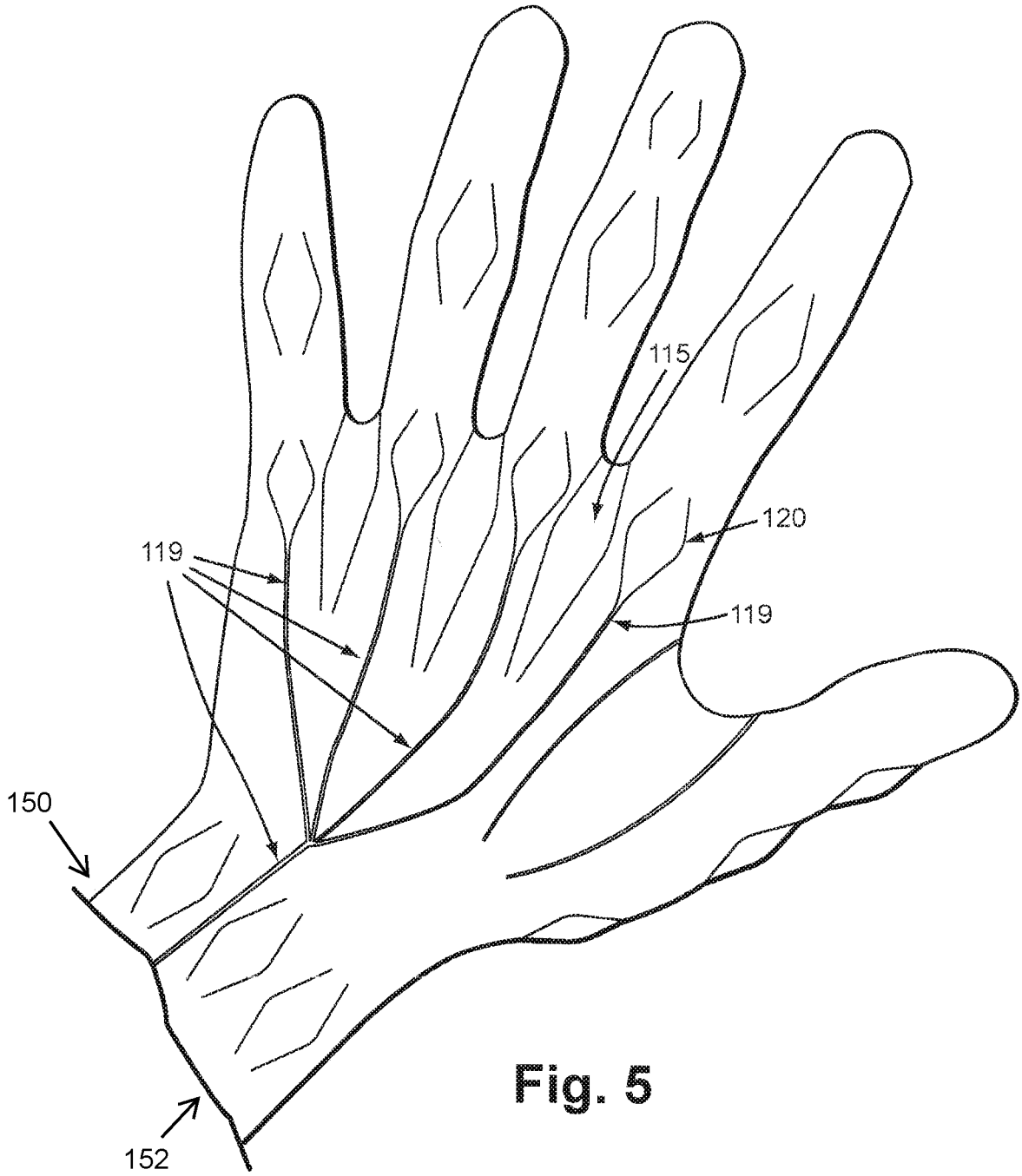
FIG. 5 is an additional embodiment of the invention which includes additional relief zones as well as a unique system of air release channels.

FIG. 5 demonstrates an additional embodiment of the glove with added features that can be incorporated into any of the above embodiments, if so desired. FIG. 5 shows knuckle relief zones 120 centered or extending over the joint where the proximal and metacarpal bones meet.

The relief zones on the knuckles, fingers, or finger joints consist of a raised symmetrical or asymmetrical, modified diamond/hump shaped relief areas with smooth transition zones where the angles of the shape converge and where the relief zones meet the uniform surface of the glove so as to create flowing transitions. The relief zones can also be elliptical (or "arcuate") over the knuckles MCP joints, PIP joints such as in FIG. 1A, (refs 115A, 123, 124)) or any shape including multiple parallel, dome or ovoid shaped relief zones that results in the desired stress relief.

The relief zones are designed to leave a gap or pocket over the finger/knuckle joints, that does not lie planar to the area of the glove surrounding it to leave room for motion of the hand/fingers before stretching occurs. By ballooning out in this way, there is a slack area where the finger/knuckle joints can encroach into during bending so that the glove material does not have to stretch as far. This is because as the fingers bend or curl, the effective length of the dorsal side of the finger and hand lengthens and the effective length of the ventral side shortens. This is easy to see on the naked hand as the skin of the knuckles tighten on the dorsal surface as the finger curls. The skin stretches to allow the finger to bend.

To this effect, the model of the hand ("hand former") may have raised areas on it to produce the humps/pockets while still allowing the smooth flow of the elastomeric material during, for example, vertical or angled dip molding. This may apply to all convergence points of all relief zones of the glove and to all convergence areas with the majority uniform surfaces of the glove.

FIG. 5 also shows an alternate system of air release channels 119 manufactured into the glove as an additional alternative feature of this invention. These air release channels aid in the release of air that might be trapped under some or all of the relief zones during donning of the glove. The channels allow air to travel along raised, grooved or formed channels the distance from any relief zone areas to an area at the base 150 of the glove or wrist or at/near the open end 152 of the glove to allow air to escape that would otherwise be trapped in the glove. This allows the glove to more closely overlay the hand without trapped "bubbles." These air release channels can be connected all together, to a plurality of relief zones or to an individual relief zone.

These air release channels can be connected to any, some or all of the relief zones anywhere on the glove/former as desired to achieve the most effective air release system including but not limited to the knuckle and finger joint relief zones. The air release channels can be located on the dorsal or ventral or on both sides of the glove. They can also incorporate the lateral relief zones. The air release channels may end within the glove or they may end exiting the glove at the base depending on the application of the glove being produced.

The digit relief zones 111, 111A (FIG. 6A), 112, 112A and 113 (FIG. 6) provide for a low stress yielding of the glove along the finger and thumb as the finger and/or thumb (collectively referred to as "digit" or "digits") curls ("flexes") from the extended position to the curled or retracted position. The digit relief zones are preferably ½-¾ the width of the fingers, and more preferably ⅔rds the maximum width of the finger of the hand wearing the glove. The knuckle relief zones 120 (FIG. 5) provide an area of the glove to yield as the hand is balled into a fist. These relief zone can be on the dorsal as well as on the ventral side of glove or on one side only. One, some, none or all of these relief zones can be utilized depending on the application of the glove being produced.

The relief zone 115 (FIG. 1, FIG. 2, FIG. 5, FIG. 12) partly between the proximal bones and between the metacarpal bones allows for release of elastomeric tension (low-stress yield) when the hand is flexed or balled during motion and during function. This relief zone can be on the dorsal as well as on the ventral side of glove or on one side only. Relief zone 115 can be continuous (see FIG. 1) through the crotch area or non-continuous (see FIG. 12) with a separate dorsal and separate ventral relief zone as described. Parts of the relief zones 115 may partially of fully encroach on the adjacent proximal and/or metacarpal bones. One or more relief zones 115 may be incorporated into the glove/former design depending on the desired functionality of the resultant glove. This relief zone is preferably ⅓-⅔ the length of the body of the hand.

The air channels 119 may be open to the environment or stop short of the open end of the glove. It may be necessary to roll the open end of the glove slightly back on itself to expose the ends of the channels to the ambient environment around the glove.

The webbing relief zone 117 provides for a low stress area of expansion as the thumb is extended away from the hand and provides freedom of movement as the thumb rotates in relation to the index finger. The webbing relief zone 117 is preferably substantially parallel but could be other shapes as well.

A typical relief zone is that on the joint of the middle finger. See for example reference 12, U.S. Pat. No. 9,179,718, issued Nov. 12, 2015 to Anstey, which is incorporated herein by reference.

The relief zones are a break in the smooth "planar" glove. The relief zone provides an area that extends, stretches or bends more easily than the simple, uniform glove areas. The relief zone preferably consists of a raised area of various shapes and sizes, but may vary according to the material or the amount of stretching required based on the underlying anatomical shapes, anatomy and associated relief needs.

Ideally, the relief areas are raised areas of material which are raised diamond or frusto-diamond shaped plateaus or humps which preferably have no sharp transition zones/angles so that elastomeric material flow during the manufacture process is kept homogenous allowing for relative consistency in glove thickness throughout.

The thickness of the glove in the relief zone areas is relatively constant and uniform with the rest of the glove.

As shown in FIGS. 1 and 2, the glove consists mainly of the back (FIG. 1) (dorsal side) of the glove having a number of relief zones, while the front (FIG. 2) (ventral side) of the glove may have mainly only the webbing relief zone 117 separately or extending on to the front of the glove. Additionally, the relief zones 115 can be incorporated on the front side of the glove as well. As is described above, the glove may have air release channels 119 as well. Finger and knuckle relief zones FIGS. 1 & 1A (references 112, 113, 115A, 122, 123 & 124) can also be located on both the front and back sides of the glove or on one side only depending on the functional requirements of the said glove being made.

The glove may also use any of the shapes or patterns of the above described glove, including the diamond/humped/ elliptical patterns or partial diamond/humped/elliptical patterns in place of or in addition to some or all of the relief zones. Additionally, the glove may be improved by adding additional material to the crotch between the fingers/digits. By moving the fingers out away from the standard distance on the hand former and then making the glove, there will be additional material between the fingers/digits providing its own type of relief zone.

The relief zones and design features demonstrated here can be implemented on one side or on both dorsal and ventral sides of the glove for the manufacturing of either hand-specific or ambidextrous gloves.

The preferred direction of the relief zones is elongated/vertical, although this invention is not limited to relief zones in any one direction. The shape of the relief zones as described on the fingers and thumb are specifically so for reasons of preventing slippage of the glove material down the fingers/thumb which would otherwise interfere with functionality and tactile feedback.

The general direction and shape of the relief zones throughout are vertically inclined (that is more along the longitudinal axis) with intention. The vertical nature of the relief zones is so designed to accommodate the gravitational pull during the manufacturing process. This allows for better flow of the elastomeric materials over the hand formers ("molds") used in the glove making process. The concavity (FIG. 6A, 111A) at the center of the relief zones can also be vertically inclined/vertical direction or horizontally inclined/horizontal direction in a horizontal relief zone as needed. This concavity can run the entire length or part of the length of the relief zone. This feature can be applied to any of the relief zones discussed in this application, The vertical nature of the relief zones and channels allows for even flow of glove making material and a more homogenous/even thickness end product which does not allow for the pooling of the elastomeric material during manufacture of the gloves. This is a very important aspect in the glove making process. Pooling of material is unacceptable as it would have a negative impact on glove performance, and it would impede or neutralize the impact that the relief zones have on stress reduction during glove use. This concept and implementation of the substantially vertical orientation of the relief areas is a key part and central element to this invention.

During manufacture using the dip molding process, a hand former is dipped into liquid elastomer finger first and the area of the hand former that is dipped forms a layer of elastomer about the mold. This forms the glove. As the mold is raised above the liquid, excess material runs down the mold and back into the liquid. By carefully designing the relief zones, the excess material can run naturally (i.e., in the vertically downward direction or close to) back into the vat of liquid. Certain relief area designs, primarily horizontal relief zones, may cause liquid to slow or pool causing the material to congregate where they dry/cool into areas of the glove that cause excessively thickened and stiffened areas of the glove. When the elastomer is not blocked during flow such as in vertically oriented relief zone designs, the excess material can drip off or flow away from the glove thereby forming a glove with a relatively consistent layer depth/thickness of the glove throughout the entire portions of the glove.

Having relief zones that are either longitudinal, mostly/substantially longitudinal, and vertically oriented or that transitions smoothly from the vertical, allow this consistent forming of the layers of the glove while providing the desired/functional relief zones. This allows for a more uniform glove using a less costly, practical process.

It is important to maintain the cost of a medical/utility glove at a practical level because these gloves are for the most part disposable or get changed out multiple times during procedures.

Gloves having stress relief zones would be of reduced value if their costs were significantly higher than the standard gloves in use today. One low cost method of making gloves of latex, nitrile, neoprene, polyisoprene, vinyl or other elastomeric materials is by using a dip mold. The current invention is not limited to the method of manufacture, but one such method is to build a base mold of, ceramic or other similar or known material. The mold relief zones described above can be built into the mold of a size and shape configured for the various size and shape desired on the product gloves. The amount, length and shape of the relief zones will depend on the glove material and the glove size (small, medium, large etc.) among other considerations. A silicone, resin, plastic, metal, nylon, ceramic or other type of cast can then be created using known methods from the master. The cast can then be dipped into the elastomeric material to form the glove which then goes through a process of which some of the steps may include heating, chlorination, vulcanization, washing and drying. Additional steps can also be incorporated in the process so as to improve various aspects of the end product. Additional dipping and steps can also be implemented to add layers to the glove to create a more durable or reusable glove such as a utility or kitchen glove. The glove can then be peeled from the cast after it has dried, cured or set.

Horizontally designed relief zones can impede this flow causing pooling of the material and thus uneven coatings along the glove, which can detract from the operation of the relief zones.

The vertical design can thus provide optimum glove construction, while minimizing costs and obviating the need for further manufacturing steps to prevent pooling, etc.

The vertical relief zones 111-121A, 123-124, 313-317 are for the most part and overall substantially parallel to the longitudinal axis of the hand/fingers and they are able to reduce the amount of effort that it takes to bend the fingers or make a fist versus other gloves of similar thickness and material. As a finger bends, the relief zone can spread apart to allow the joint or soft tissue to push up into the relief zone and stretch the relief zones laterally as well. This can provide not only stress relief for the areas directly under the relief zones but to adjacent areas as well.

Figure 10:
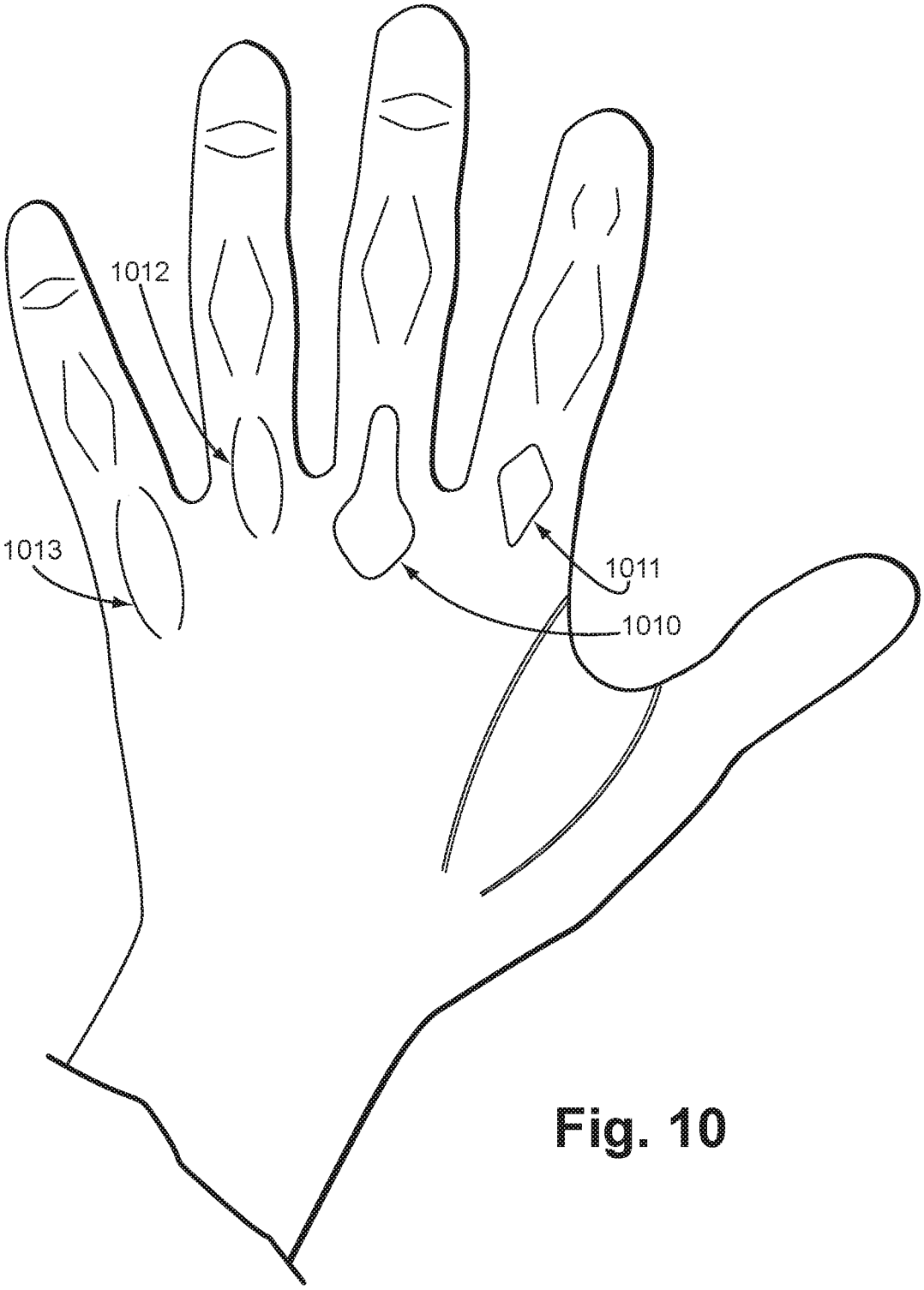
FIG. 10 is a diagrammatic view of an alternate embodiment of the glove showing finger crotch relief zones.
Figure 11:
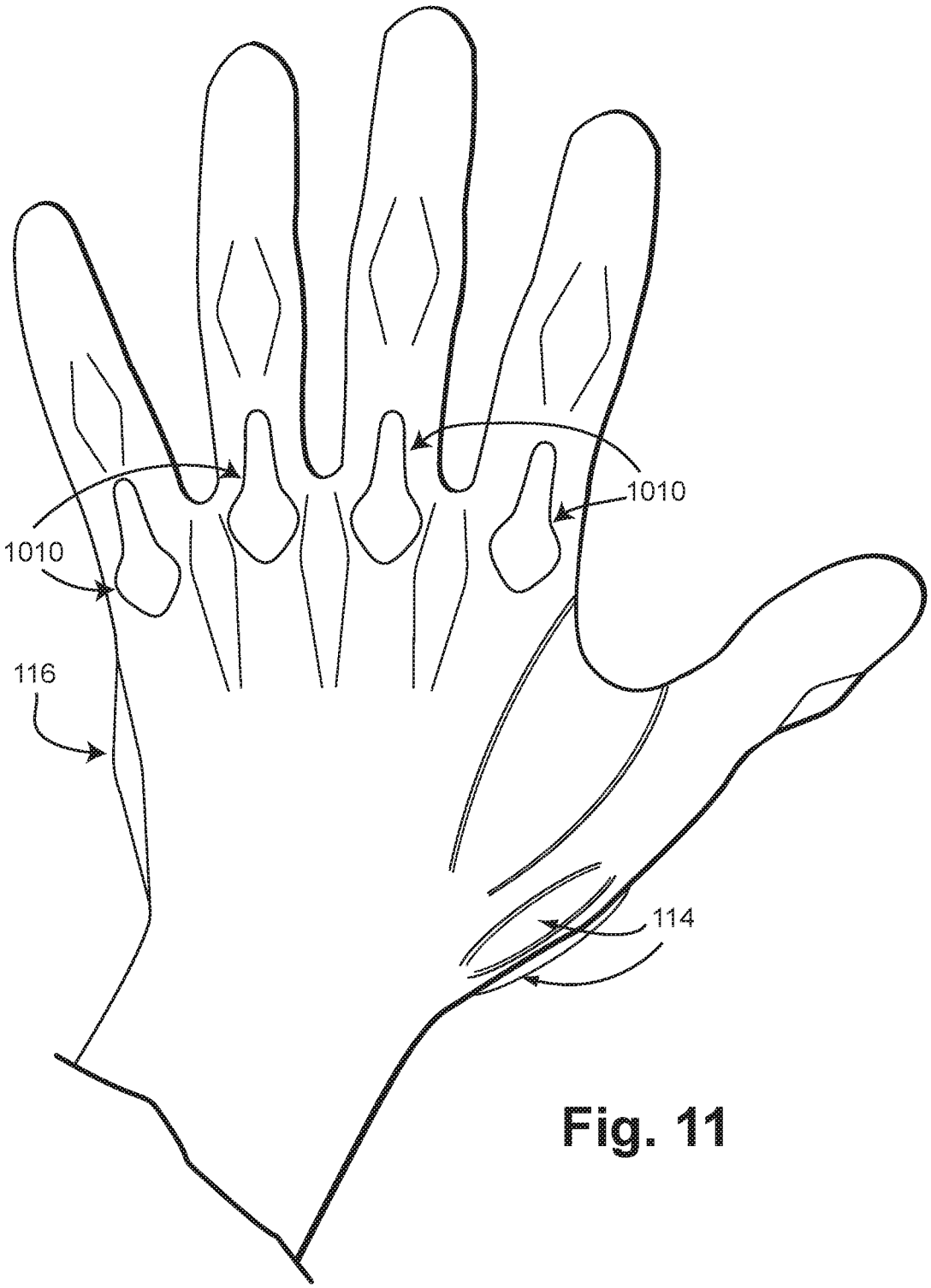
FIGS. 11-12 show alternate embodiments of the glove.

With reference to FIGS. 10 and 11, numerals 1010-1013 show various finger crotch relief zones. For the purposes of this application, unless otherwise explicitly specified, abduction and adduction are defined as motions of the limbs, hand, fingers, or toes in the coronal (medial-lateral) plane of movement. Moving the limb or hand laterally away from the body, such as spreading the fingers or toes, is abduction.

During abduction (spreading apart) and movement of the fingers, these crotch relief zones serve to reduce the stress that builds up in the glove material. These relief zones provide extra material to accommodate the movement of fingers with a reduced lateral tension and constriction normally caused by the material pulling on function. The current design of the finger crotch stress relief zones helps to reduce the overall forces in this area and in the adjacent areas of the hand. In so doing, the muscles of the hand undergo less fatigue during movement and abduction of the fingers and the overall stress on the associated soft tissue, bones, nerves and blood vessels is mitigated. This concept just described may apply to all the stress relief zones discussed in this application.

The finger crotch relief zones can be any shape. The preferred embodiments as shown in FIGS. 10 and 11 are symmetrical or asymmetrical, elliptical (or arcuate), frusto-diamond shaped (1011), ice-cream cone shaped (1010), rod-shaped, dome shaped, elliptical or arcuate (1012,1013). These relief zones can partially or fully overlay the MCP joint area and the area over the proximal phalanges. The number and shape of these relief zones implemented depends on the desired glove being made. The finger crotch relief zones can be present on the dorsal, ventral or on both the dorsal and ventral side of the glove and glove former.

Frusto-diamond shaped and ice cream cone shaped finger crotch relief zones 1010-1013 as well as the 115/115A (FIG. 1) relief zones allow for lateral expansion of the glove material. This primary lateral expansion then results in a secondary spread in expansion in other directions including in the longitudinal direction. This provides for an overall non-obvious, stress relief during functioning of the hand. This discovery of how a non-obvious design and location of a relief zone in the above-mentioned areas, contributes to the decrease in stress and hand fatigue during function. This can be regarded as one of the unique and novel features of this invention.

Figure 12:
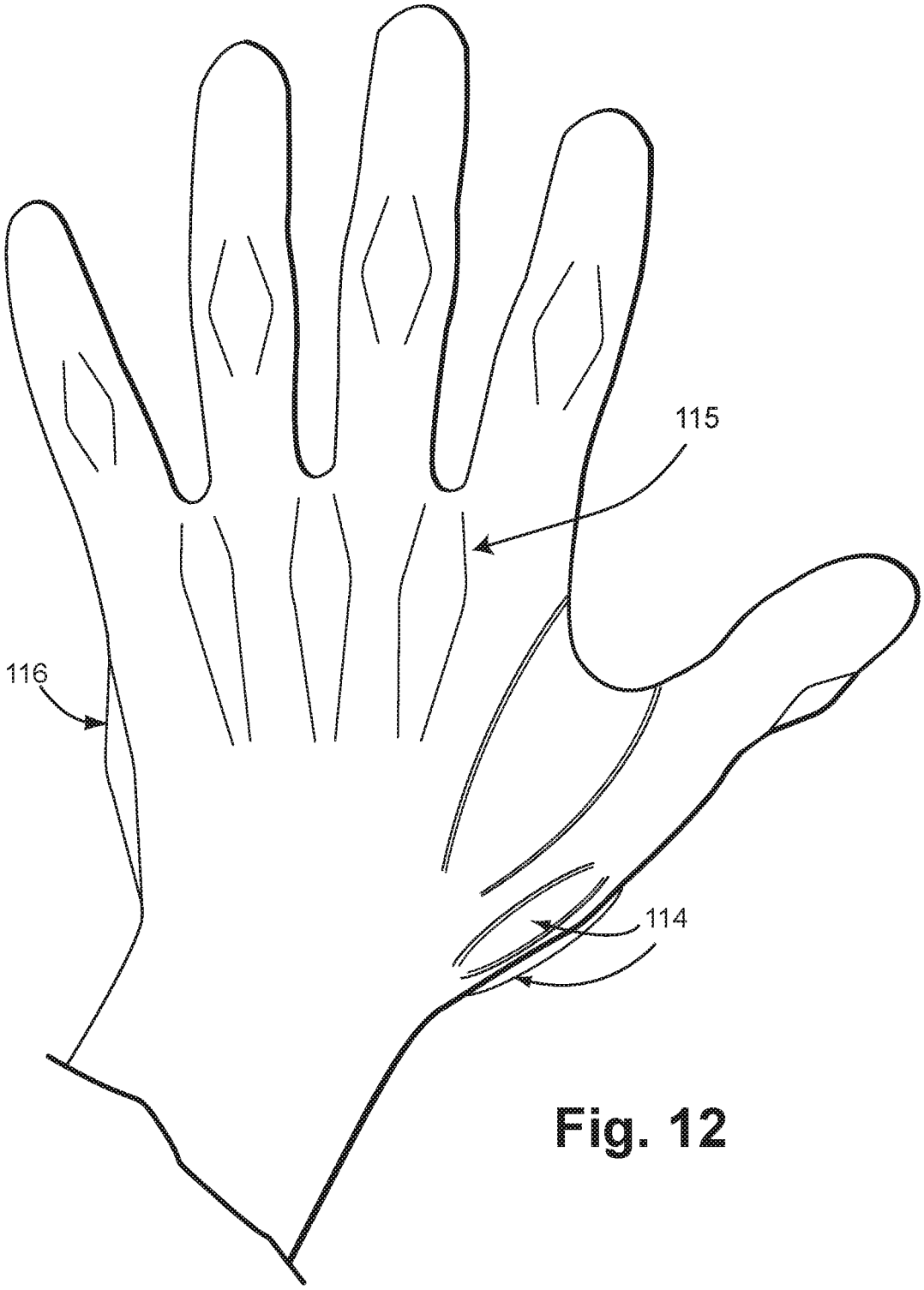

FIG. 12 shows another embodiment having relief zones 114 and 116, but without relief zone 1010.

The shape and location of the relief zones accommodates more movement/bending of the fingers without causing as much tension in the glove itself. In a preferred embodiment, the glove material is of a relatively uniform thickness even throughout the relief zones but could also be thinner in portions of the relief zones.

The relief zone 115 (FIG. 1) can extend into the crotch area 154 between the digits but it can also stop short of this crotch area 154. The relief zone 115 allows for expansion of the said relief zones when the fingers spread open during hand movement. This feature allows for further reduction in stress associated with standard gloves in this area that do not have any relief zones in this area. The fingers and hand will thus experience less fatigue than if the fingers are fighting against the pull of the material as the fingers flex and curl. The relief zone action between the fingers also prevents constriction of the bones and soft tissue and help to mitigate the associated neurologic and bone injuries reported in this area.

In a similar fashion, the webbing relief area 117 (FIG. 1), reduces the amount of stress in the glove and thus the pressure on the thumb muscles and webbing of the hand as the thumb moves away from the hand or rotates. The webbing relief zone 117 can be located separately on the back and front of the hand or can extend from the back of the hand around to the palm area of the hand to provide for additional relief of the webbing area throughout the entire motion of the thumb.

This relief zone 117 also allows the glove material to keep in close contact with the webbing of the hand instead of pulling out of contact as a normal glove can do due to glove tension in this area (known as the trampoline effect). This allows the user to wear a closer fit glove rather than relying on the extra material of a larger glove to allow for free motion of the hand and thumb within the glove. The relief zones 114 (FIG. 1, FIG. 4, FIG. 4A) are also effective at helping reduce this trampoline effect thereby helping to reduce stress in the webbing relief zone area.

For the purposes of the claims of this application only, unless otherwise explicitly stated, we use the term "knuckle" to refer to the MCP joint below the fingers (near 115/115A) and finger joint to refer to the joints in the finger above the crotch of the fingers (near 112 or 113) to distinguish the two areas.

For the purposes of the claims of this application only, unless otherwise explicitly stated, the term "hand" includes the fingers and thumb of the hand.

While this invention has been described as having a preferred design, it is understood that it is capable of further modifications, uses and/or adaptations of the invention following in general the principle of the invention and including such departures from the present disclosure as come within the known or customary practice in the art to which the invention pertains and as may be applied to the central features hereinbefore set forth, and fall within the scope of the invention and the limits of the appended claims. Additionally, any of the features shown in one embodiment can be used in combination with any features of any other embodiment.

The Applicant notes that wherever the application states that a glove is shown in the drawings or written description, that the drawing or description could refer to the respective glove former on which the glove was made. For example, where a figure shows a glove having an arcuate relief zone, the glove also depicts the details of the respective glove former thereunder having the same arcuate structure to produce the arcuate relief zone. It is not believed that a separate figure of the former relief zone is required to comply with the written description to instruct one of ordinary skill in the art to make, use or sell the invention without undue experimentation. The invention thus covers and encompasses the hand former for producing a glove described in this application and all the permutations therein.

It is therefore to be understood that the present invention is not limited to the sole embodiment described above, but encompasses any and all embodiments within the scope of the following claims.

I claim:

1. A glove, comprising:

a ventral portion, a dorsal portion, a palm portion, finger portions including an index finger portion and two adjacent finger portions, and a thumb portion;

a top end at a wrist portion of the glove and a bottom end at a remote end of each of the finger portions; and a plurality of relief zones and a plurality of non-relief portions positioned between the plurality of relief zones, each of the plurality of relief zones comprising raised areas between the non-relief portions, thereby the plurality of relief zones providing less resistance to flexing than the non-relief portions positioned therebetween by exhibiting lower spring force in the plurality of relief zones when compared to the non-relief portions, a first one of the plurality of relief zones is positioned between the two adjacent finger portions and is adapted for location between metacarpal bones, the first one of the plurality of relief zones consists of a raised area including a longitudinal axis extending substantially parallel to a long axis of each of the two adjacent finger portions between which the first one of the plurality of relief zones is positioned, the raised area of the first one of the plurality of relief zones extends from a crotch area between the two adjacent finger portions to a non-relief portion along the palm portion and comprises a smooth transition between the first one of the plurality of relief zones and the non-relief portion in the palm portion such that the non-relief portion extends from the wrist portion to the smooth transition along the palm portion, wherein the raised area of the first one of the plurality of relief zones is adapted to be ⅓ to ⅔ the length of a hand of a user such that the smooth transition between the first one of the plurality of relief zones is along the palm portion, and a second one of the plurality of relief zones is positioned between the index finger portion and the thumb portion, the second one of the plurality of relief zones positioned between the index finger portion and the thumb portion includes a raised area having only flat or arched surfaces, only smooth transitions between the second one of the plurality of relief zones positioned between the index finger portion and the thumb portion and non-relief portions of the glove, and only a smooth transition from one side of the second one of the plurality of relief zones positioned between the index finger portion and the thumb portion to another side of the second one of the plurality of relief zones positioned between the index finger portion and the thumb portion such that the second one of the plurality of relief zones positioned between the index finger portion and the thumb portion leaves room for motion of a hand/fingers before stretching occurs;

wherein the first one of the plurality of relief zones is of a different size and shape than the second one of the plurality of relief zone, and the combination of the plurality of relief zones and the plurality of non-relief zones helps in maintaining positioning of the glove on the hand and resisting glove slippage by allowing a more form fitting glove to be used that provides the comfort similar to a larger glove; and wherein the glove is constructed from a thin layer of polymeric material and the glove has a substantially uniform thickness, including the plurality of relief zones and the non-relief portions.

2. The glove of claim 1, wherein the first one of the plurality of relief zones is adapted for location between metacarpal bones and adapted to extend into webbing areas adjacent to proximal phalanges.

3. The glove of claim 1, wherein the first one of the plurality of relief zones is adapted for location between metacarpal bones and adapted to extend from one side of the hand to the other through crotch areas between the fingers.

4. The glove of claim 1, wherein the first one of the plurality of relief zones is adapted for location between metacarpal bones on the dorsal portion and/or ventral portion of the glove.

5. The glove of claim 1, wherein the first one of the plurality of relief zones is adapted for location between metacarpal bones on only the dorsal portion.

6. The glove of claim 1, wherein the first one of the plurality of relief zones is adapted for location between metacarpal bones and adapted to extend along an axis parallel to a long axis of the hand.

7. The glove of claim 1, wherein the plurality of relief zones include at least one pocket for selectively receiving at least a portion of a hand therein.

8. The glove of claim 7, wherein the plurality of relief zones are frusto-diamond shaped.

9. The glove of claim 1, wherein the first one of the plurality of relief zones is tapered from a direction nearest the top end continuously outward from a first width to a second width along a first portion of the length of the first one of the plurality of relief zones and the first one of the plurality of relief zones is tapered inwardly from the second width along a second portion of the length of the first one of the plurality of relief zones.

10. The glove according to claim 1, further including an additional relief zone adapted for location in the vicinity of or over a carpo-metacarpal joint of the thumb, associated metacarpal/carpal bones and adjacent thenar muscle group.

11. The glove according to claim 10, further including a further relief zone adapted for location on a lateral side on a pinkie side of a hand.

12. The glove according to claim 11, further including yet a further relief zone adapted for location over an interphalangeal joint of the thumb and/or a metacarpo-phalangeal joint of the thumb.

13. The glove according to claim 10, further including yet a further relief zone adapted for location over an interphalangeal joint of the thumb and/or a metacarpo-phalangeal joint of the thumb.

* * * * *